US005433792A

United States Patent [19]

Darlington

[11] Patent Number: 5,433,792

[45] Date of Patent: Jul. 18, 1995

[54] COMPOUND ARCHERY BOW

[75] Inventor: Rex F. Darlington, Hale, Mich.

[73] Assignee: Container Specialties, Inc., Flint, Mich.

[21] Appl. No.: 222,481

[22] Filed: Apr. 4, 1994

[51] Int. Cl.[6] ..... F41B 5/10; F41B 5/14

[52] U.S. Cl. ..... 124/25.6; 124/23.1; 124/86; 124/88

[58] Field of Search ..... 124/23.1, 24.1, 25.6, 124/86, 88, 89; 403/257, 258, 259, 333, 334

[56] References Cited

U.S. PATENT DOCUMENTS

| | | | |
|---|---|---|---|
| 3,738,348 | 6/1973 | Karbo | 124/23.1 |
| 3,814,075 | 6/1974 | Hoyt | 124/23.1 |
| 3,821,946 | 7/1974 | Griggs | 124/23.1 |
| 3,957,027 | 5/1976 | Drake | 124/23.1 |
| 4,060,066 | 11/1977 | Kudlacek | 124/25.6 |
| 4,078,538 | 3/1978 | Shepley | 124/25.6 |
| 4,201,182 | 5/1980 | Butler | 124/25.6 |
| 4,261,320 | 4/1981 | Barna | 124/25.6 |
| 4,793,319 | 12/1988 | Vaughan et al. | 124/25.6 |
| 4,846,142 | 7/1989 | Tone | 124/25.6 |
| 5,002,035 | 3/1991 | Brooks | 124/23.1 |
| 5,161,514 | 11/1992 | Cary | 124/88 X |
| 5,178,122 | 1/1993 | Simonds | 124/25.6 |
| 5,231,970 | 8/1993 | Ploot et al. | 124/23.1 |
| 5,339,790 | 8/1994 | Smith | 124/25.6 |

FOREIGN PATENT DOCUMENTS 2459013 8/1976 Germany ..... 124/86

*Primary Examiner*—Eric K. Nicholson
*Assistant Examiner*—John A. Ricci
*Attorney, Agent, or Firm*—Barnes, Kisselle, Raisch, Choate, Whittemore & Hulbert

[57] ABSTRACT

A compound archery bow that includes a handle having a pair of flexible limbs mounted on and projecting from spaced ends of the handle. A bow handle is of cast magnesium construction, and cable guide and limb mounting arrangements employ inexpensive hardware in place of expensive manufacturing processes to provide mounting openings. In one embodiment, the handle includes a laterally opening pocket, a nut received in the pocket, and a screw extending through the limb into the pocket and received in the nut. In another embodiment, a first opening with a threaded insert is provided in the handle. A second threaded opening intersects the first opening. A screw extends through the limb into the first opening. A set screw is provided in the second opening to lock the limb screw. In another embodiment, the handle is provided with an opening that tapers toward the rear. A tapered bushing is received in the opening. A screw extends through a cable guide into the bushing to mount same. In another embodiment, a limb pivot arrangement is provided which includes a pair of concave channels on the handle, and complementary part-spherical bosses on the limb.

39 Claims, 3 Drawing Sheets

COMPOUND ARCHERY BOW

The present invention is directed to compound archery bows, and particularly to improvements associated with compound archery bow handles of mold-formed construction such as cast magnesium.

A general object of the present invention is to provide a compound archery bow that is characterized by reduced manufacture and assembly cost associated with mounting of bow components on the bow handle—e.g., less expensive molds and tooling for the bow handle. A more specific object of the present invention is to provide a compound archery bow having a mold-formed handle of cast magnesium, for example, with improved means for mounting the bow limbs, bow cable guide and/or other bow accessories on the handle. In general, these improvements involve elimination of separate machining operations characteristic of the prior art for drilling and tapping mounting openings in the handle subsequent to the casting operation.

The invention, together with additional objects, features and advantages thereof, will be best understood from the following description, the appended claims and the accompanying drawings in which:

Figure 1:
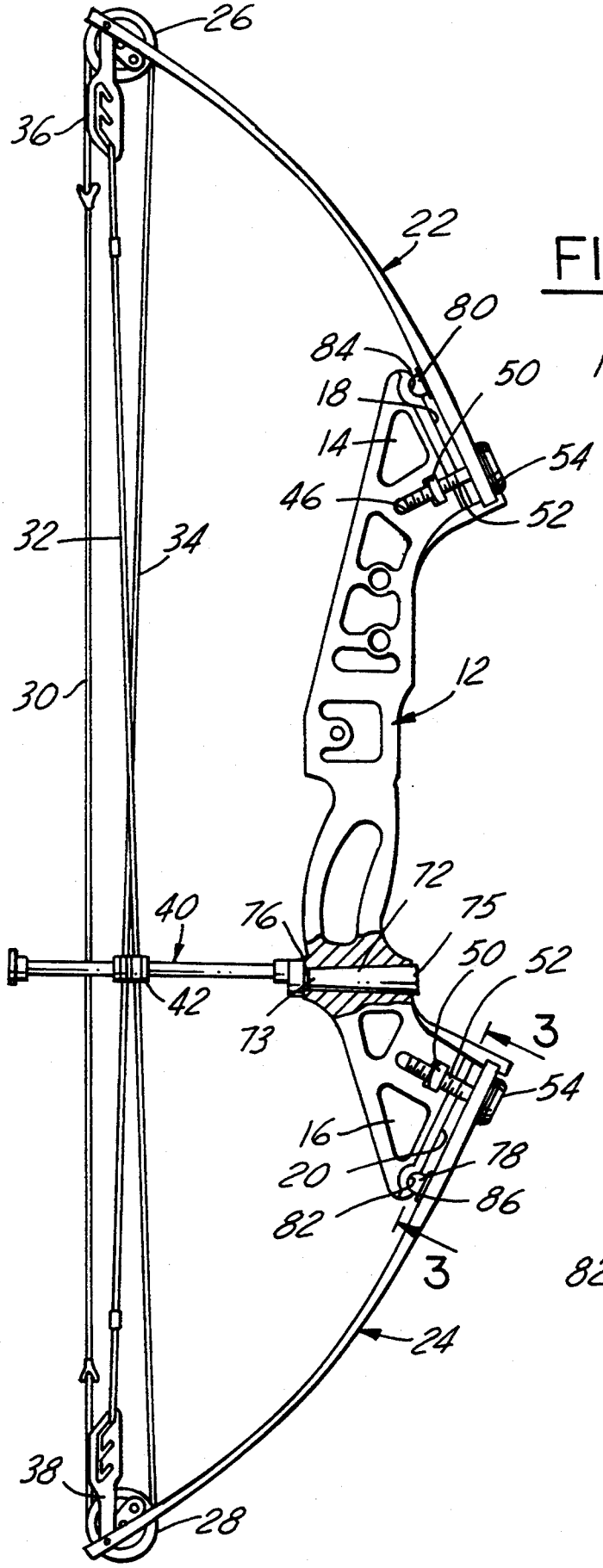
FIG. 1 is a side elevational view of a compound archery bow in accordance with one presently preferred embodiment of the invention.

FIG. 1 illustrates a compound archery bow 10 that includes a cast magnesium handle 12 having spaced ends 14,16 with flat limb-mounting surfaces 18,20 at an angle to each other. A pair of flexible limbs 22,24 of fiber reinforced resin or other suitable construction are mounted on handle ends 14,16 respectively, and project therefrom away from handle 12. Each limb 22,24 has an associated cable pulley 26,28 rotatably mounted at the handle-remote end or tip thereof. A bow string 30 extends between pulleys 26,28. A pair of cables 32,34 are fastened at one end to limbs 22,24 by tension adjusters 36,38 respectively, and extend to and are trained over the pulley 28,26 at the end of the opposing limb and fastened to drawstring 30. A cable guide 40 is fastened at one end to handle 12, and carries a slider 42 that receives cables 32,34 for guiding motion of the cables as string 30 is drawn and released. To the extent thus far described, bow 10 is of conventional construction.

Figure 3:
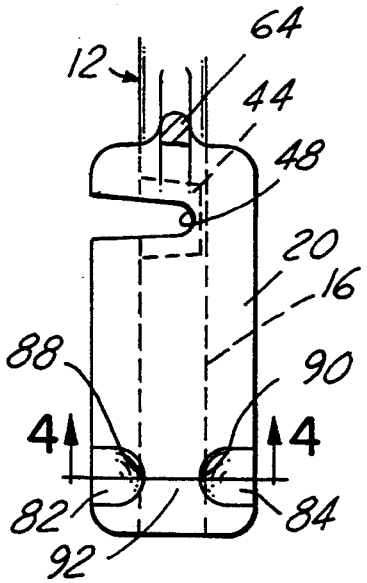
FIG. 3 is a fragmentary elevational view of a portion of the bow handle illustrated in FIG. 1, being taken substantially along the line 3—3 in FIG. 1.
Figure 2:
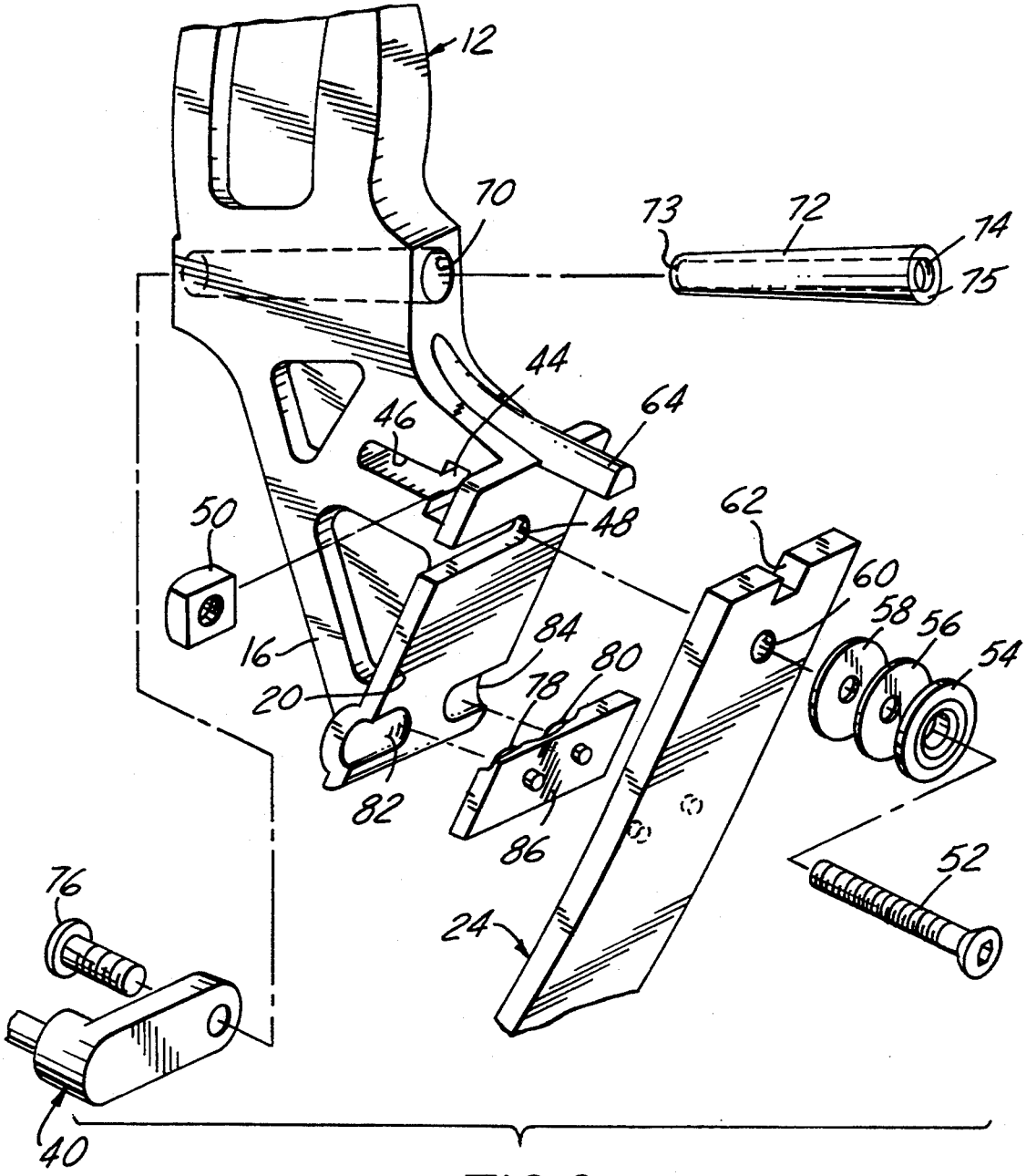
FIG. 2 is a fragmentary exploded perspective view of a portion of the bow illustrated in FIG. 1.

In accordance with a first aspect of the present invention, bow limbs 22,24 are mounted to respective ends 14,16 of handle 12 by limb-mounting arrangements best illustrated in FIGS. 1–3. A generally rectangular pocket 44 opens laterally outwardly—i.e., laterally of the longitudinal dimension of the handle and to the direction of string draw—adjacent to limb-mounting surfaces 18,20 at each handle end 14,16. A laterally opening channel 46 intersects each pocket 44 and opens to the associated adjacent surface 18,20 at right angles to the surface and the pocket. A lateral slot 48 extends along each planar surface 18,20, having an inner end aligned with the associated channel 46. A nut 50 is loosely removably received in each pocket 46. A screw 52 extends through a series of washers 54,56,58, through an opening 60 in each limb 22,24, and thence through slot 48 into channel 46 so as to be threadably received within nut 50 in pocket 44. A notch 62 at the inner end of each limb 22,24 cooperates with a corresponding projection or boss 64 adjacent to each limb-mounting surface 18,20 to assist in aligning of the limb with the handle during assembly and use.

The limb-mounting arrangement so illustrated in FIGS. 1–3 and described above may be contrasted with the conventional practice of drilling and tapping mounting openings at the respective ends of the handle for threadably receiving screws 52. Pocket 44, channel 46 and slot 48 may be readily formed during the handle-casting operation with no special core pulls, thus requiring no additional or special manufacturing process steps. As best seen in FIG. 1, the pockets 44, channels 46 and slots 48 at both ends of the handle open in the same lateral direction, and are tapered (FIG. 3) at the angle of the casting draft. Nut 50 is a standard and inexpensive hardware element that is assembled to the handle after the casting operation. Thus, the expensive drilling and tapping process of the prior art is essentially replaced by an inexpensive hardware element. In addition, since screws 52 and nuts 50 are readily visible from the side of the bow, they may be observed during adjustment of bow tension, by loosening or tightening screws 52, which helps prevent inadvertent complete loosening of the screws.

In accordance with a second aspect of the present invention also illustrated in FIGS. 1 and 2, a through-opening 70 is formed in handle 12, preferably by a plug positioned in the mold prior to casting of the handle. Opening 70 is of frusto-conical geometry, taping narrowingly from front to back of the handle, which is to say that the end of lesser diameter is adjacent to bow cables 32,34 as best seen in FIG. 1. A conical bushing 72 is removably received within opening 70. Conical bushing 72 has a through-opening 74 that is internally threaded at least adjacent to the axial ends of the bushing. Cable guide 40 is mounted to handle 12 by means of a screw 76 (FIG. 2) that extends through guide 40 to be threadably received within the narrow end of bushing 72. Preferably, the length of bushing 72 is such that the end 73 of lesser diameter does not reach the inner surface of handle 12, as seen in FIG. 1, while the end 75 of greater diameter projects slightly from the outer handle surface. This construction ensures firm seating of the bushing within the handle, while providing a small mounting boss on the outer surface of the handle.

Thus, plug-formed opening 70, in combination with bushing 72 with internally threaded through-opening 74, replaces the drilling and tapping operation conventional in the prior art for providing a threaded opening for mounting of cable guide 40. As screw 76 is tightened to mount cable guide 40, bushing 72 is drawn into handle opening 70, so that bushing 72 is essentially self-tightening in operation. Furthermore, with the outer (wider) end of bushing 72 also being internally threaded, there is thus automatically provided at no additional cost a mounting opening for conventional bow accessories such as a stabilizer or bow-fishing reel.

It is conventional practice to provide a pair of laterally aligned hemispheric bearing bosses 78,80 on the inner face of each limb 22,24 adjacent to the associated mounting screw 52, and to provide correspondingly laterally aligned outwardly opening pockets 82,84 on the opposing faces 18,20 of the handle. The hemispheric bearing bosses are received within the pockets and provide for pivotal motion of the limbs as the mounting screws 52 are loosened and tightened. Bosses 78,80 are formed on a plate 86 that is adhesively secured or otherwise suitably fastened to the inner face of the limb adjacent to the mounting opening.

Figure 4:
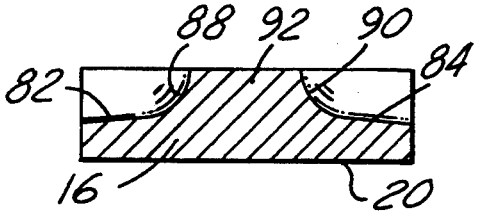
FIG. 4 is a sectional view taken substantially along the line 4—4 in FIG. 3.

In accordance with a third aspect of the present invention, the pockets 82,84 are formed as laterally aligned oppositely opening channels that have spherical inner channel ends 88,90 separated from each other by a portion of the handle end that forms a rib 92. The channel ends 88,90 are part-spherical, having the same radius of curvature as bosses 78,80 (which are identical to each other), and having a depth that is less than the height of the bearing bosses. Channels 82,84 have angulated lower surfaces, as best seen in FIG. 4, at the draft angle of the handle mold. This construction has two advantages. First, the part-spherical inner ends 88,90 of channels 82,84 cooperate with the hemispheric contour of bearing bosses 78,80 to render the bearing/channel arrangement self-centering during assembly. Projection 64 cooperating with notch 62 at the handle end, and the bearing/boss arrangement described immediately above, provide three-point location of the limb end with respect to the handle while accommodating tolerance variations during the molding operation. Furthermore, with channels 82,84 being open to the sides of the handle and at the draft angle of the handle, the mold elements do not tend to lock up with the handle during the casting operation, as has often been the case with the prior art.

Figure 5:
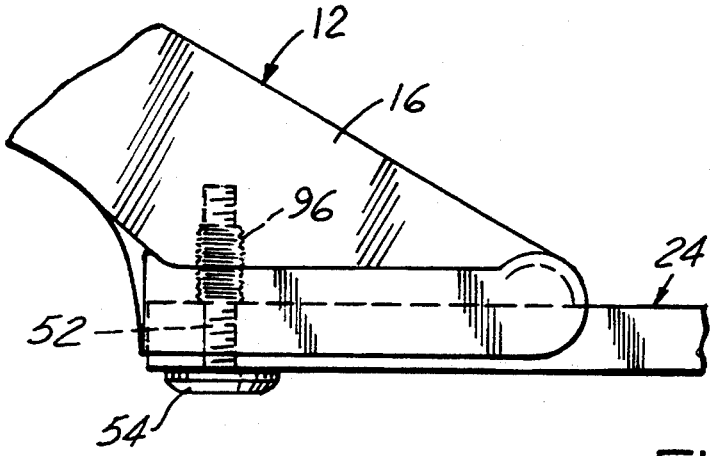
FIG. 5 is a fragmentary elevational view of a bow showing attachment of a limb to the handle in accordance with a modified embodiment of the invention.
Figure 6:
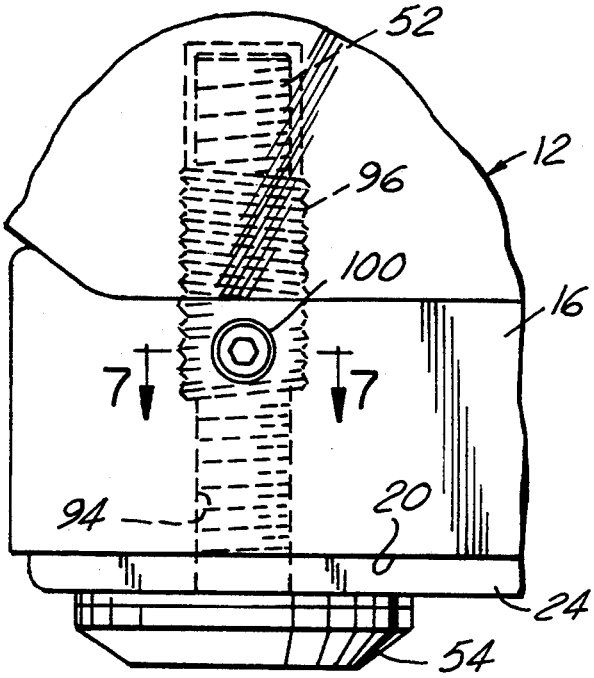
FIG. 6 is a fragmentary view on an enlarged scale of a portion of the limb attachment arrangement illustrated in FIG. 5.
Figure 7:
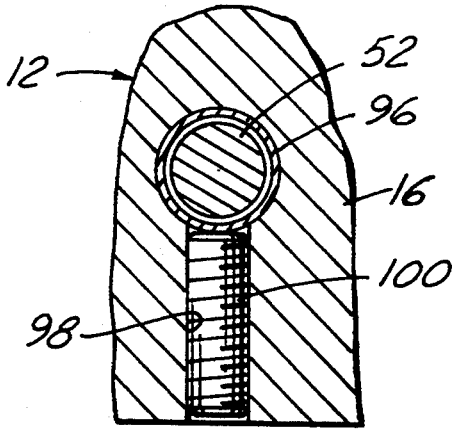
FIG. 7 is a fragmentary sectional view taken substantially along the line 7—7 in FIG. 6.

FIGS. 5–7 illustrate a modified limb-mounting arrangement in accordance with a fourth aspect of the present invention. It will be understood, of course, that the mounting arrangement is identical at both ends of the handle. An first internally threaded opening 94 extends inwardly from mounting surface 20. A thread insert 96 is placed in each opening 94. Inserts 96 are known per se, being of helically coiled construction and of diameter slightly greater than the diameter of the openings into which they are threaded so that they are self-retaining in operation. A second internally threaded opening 98 adjacent to the handle end laterally intersects opening 94 through thread insert 96. Screw 52 extends through limb 24 and is threadably received in insert 96. A set screw 100 is then threaded into opening 98 and tightened against insert 96. In this way, screw 52 is locked in insert 96 without damaging the screw threads. When it is desired to loosen or tighten screw 52 so as to adjust draw force of the bow, set screw 100 is first loosened, screw 52 is adjusted as desired, and set screw 100 is retightened so as to hold the adjustment position.

I claim:

1. A compound archery bow that includes a handle having spaced ends, a pair of limbs mounted on and projecting from said handle ends, a pair of pulleys rotatably mounted on ends of said limbs remote from said handle, a draw string extending between said pulleys, and cables anchored at each said limb end and extending to said draw string around the pulley at the opposing limb end, characterized in that each said limb is attached to the associated end of said handle by limb attachment means that comprises:

a laterally opening pocket in said handle adjacent to said handle end, a nut removably received in said pocket, and a screw extending through said limb into said handle end and threadably received in said nut.

2. The bow set forth in claim 1 wherein each of said limb attachment means further comprises a laterally opening channel in said handle adjacent to said handle end and intersecting said pocket, said screw being disposed within said channel.

3. The bow set forth in claim 2 wherein said pockets and channels of both said limb attachment means open in the same direction laterally of said handle.

4. The bow set forth in claim 3 wherein said handle is of mold-formed construction.

5. The bow set forth in claim 2 further comprising a cable guide attached to said handle and extending to said cables, characterized in that said cable guide is attached to said handle by guide attachment means that comprises:

an opening in said handle that tapers narrowingly toward said cables, an internally threaded tapered bushing in said opening, and a screw extending from a side of said handle adjacent to said cables through said cable guide and threadably received in said bushing, such that said bushing is self-seating and self-tightening in said handle opening upon tightening of said screw to attach said cable guide.

6. The bow set forth in claim 5 wherein said opening and bushing are of conical geometry.

7. The bow set forth in claim 6 wherein said bushing has a passage extending entirely therethrough, said passage being internally threaded at both ends, the end of said bushing of greater diameter being adjacent to a surface of said handle remote from said cables to provide an internally threaded mounting opening for bow accessories.

8. The bow set forth in claim 2 in which said limbs are each mounted on said handle ends by a screw that extends through the limb into said handle and bearing means adjacent to said screw to permit pivoting of the limb with respect to said handle end, characterized in that each said bearing means comprises:

a pair of aligned channels that extend in opposite lateral directions at said handle end, said channels having a circular cross-section viewed laterally of said handle, and a pair of part-spherical bosses on said limb and disposed in respective ones of said channels.

9. The bow set forth in claim 8 wherein said channels each have part-spherical ends adjacent to each other, such that said bosses on said limbs are self-centering in said channels upon tightening of said screw.

10. The bow set forth in claim 9 wherein said channels are of conical geometry, having a radius of curvature that increases laterally outwardly of each said channel.

11. A compound archery bow that includes a handle having spaced ends, a pair of limbs mounted on and projecting from said handle ends, a pair of pulleys rotatably mounted on ends of said limbs remote from said handle, a draw string extending between said pulleys, cables anchored at each said limb end and extending to said draw string around the pulley at the opposing limb end, and a cable guide attached to said handle and extending to said cables, characterized in that said cable guide is attached to said handle by guide attachment means that comprises:

an opening in said handle that tapers narrowingly toward said cables, an internally threaded tapered bushing in said opening, and a screw extending from a side of said handle adjacent to said cables through said cable guide and threadably received in said bushing, such that said bushing is self-seating and self-tightening in said handle opening upon tightening of said screw to attach said cable guide.

12. The bow set forth in claim 11 wherein said opening and bushing are of conical geometry.

13. The bow set forth in claim 12 wherein said bushing has a passage extending entirely therethrough, said passage being internally threaded at both ends, the end of said bushing of greater diameter being adjacent to a surface of said handle remote from said cables to provide an internally threaded mounting opening for bow accessories.

14. The bow set forth in claim 11 wherein each said limb is attached to the associated end of said handle by limb attachment means that comprises:

a laterally opening pocket in said handle adjacent to said handle end, a nut removably received in said pocket, and a screw extending through said limb into said handle end and threadably received in said nut.

15. The bow set forth in claim 14 wherein each of said limb attachment means further comprises a laterally opening channel in said handle adjacent to said handle end and intersecting said pocket, said screw being disposed within said channel.

16. The bow set forth in claim 15 wherein said pockets and channels of both said limb attachment means open in the same direction laterally of said handle.

17. The bow set forth in claim 16 wherein said handle is of mold-formed construction.

18. The bow set forth in claim 11 wherein said limbs are each mounted on said handle ends by a screw that extends through the limb into said handle and bearing means adjacent to said screw to permit pivoting of the limb with respect to said handle end, characterized in that each said bearing means comprises:

a pair of aligned channels that extend in opposite lateral directions at said handle end, said channels having a circular cross section viewed laterally of said handle, and a pair of part-spherical bosses on said limb and disposed in respective ones of said channels.

19. The bow set forth in claim 18 wherein said channels each have part-spherical ends adjacent to each other, such that said bosses on said limbs are self-centering in said channels upon tightening of said screw.

20. The bow set forth in claim 19 wherein said channels are of conical geometry, having a radius of curvature that increases laterally outwardly of each said channel.

21. The bow set forth in claim 11 wherein each said limb is attached to the associated end of said handle by limb attachment means that comprises:

a first internally threaded opening adjacent to said handle end, a second internally threaded opening adjacent to said handle end laterally intersecting said first opening, a thread insert in said first opening at a position intersecting said second opening, a limb-attachment screw extending through said limb into said first opening and threadably received in said thread insert, and a set screw threadably received in said second opening in external abutment with said thread insert to lock said limb-attachment screw in said thread insert.

22. A compound archery bow that includes a handle having spaced ends, a pair of limbs mounted on and projecting from said handle ends, a pair of pulleys rotatably mounted on ends of said limbs remote from said handle, a draw string extending between said pulleys, and cables anchored at each said limb end and extending to said draw string around the pulley at the opposing limb end, said limbs each being mounted on said handle ends by a screw that extends through the limb into said handle and bearing means adjacent to said screw to permit pivoting of the limb with respect to said handle end, characterized in that each said bearing means comprises:

a pair of aligned channels that extend in opposite lateral directions at said handle end, said channels having a circular cross-section viewed laterally of said handle, and a pair of part-spherical bosses on said limb and disposed in respective ones of said channels.

23. The bow set forth in claim 22 wherein said channels each have part-spherical ends adjacent to each other, such that said bosses on said limbs are self-centering in said channels upon tightening of said screw.

24. The bow set forth in claim 23 wherein said channels are of conical geometry, having a radius of curvature that increases laterally outwardly of each said channel.

25. The bow set forth in claim 22 wherein each said limb is attached to the associated end of said handle by limb attachment means that comprises:

a laterally opening pocket in said handle adjacent to said handle end, a nut removably received in said pocket, and a screw extending through said limb into said handle end and threadably received in said nut.

26. The bow set forth in claim 25 wherein each of said limb attachment means further comprises a laterally opening channel in said handle adjacent to said handle end and intersecting said pocket, said screw being disposed within said channel.

27. The bow set forth in claim 26 wherein said pockets and channels of both said limb attachment means open in the same direction laterally of said handle.

28. The bow set forth in claim 27 wherein said handle is of mold-formed construction.

29. The bow set forth in claim 22 further comprising a cable guide attached to said handle and extending to said cables, characterized in that said cable guide is attached to said handle by guide attachment means that comprises:

an opening in said handle that tapers narrowingly toward said cables, an internally threaded tapered bushing in said opening, and a screw extending from a side of said handle adjacent to said cables through said cable guide and threadably received in said bushing, such that said bushing is self-seating and self-tightening in said handle opening upon tightening of said screw to attach said cable guide.

30. The bow set forth in claim 29 wherein said opening and bushing are of conical geometry.

31. The bow set forth in claim 30 wherein said bushing as a passage extending entirely therethrough, said passage being internally threaded at both ends, the end of said busing of greater diameter being adjacent to a surface of said handle remote from said cables to provide an internally threaded mounting opening for bow accessories.

32. The bow set forth in claim 22 wherein each said limb is attached to the associated end of said handle by limb attachment means that comprises:

a first internally threaded opening adjacent to said handle end, a second internally threaded opening adjacent to said handle end laterally intersecting said first opening, a thread insert in said first opening at a position intersecting said second opening, a limb-attachment screw extending through said limb into said first opening and threadably received in said thread insert, and a set screw threadably received in said second opening in external abutment with said thread insert to lock said limb-attachment screw in said thread insert.

33. A compound archery bow that includes a handle having spaced ends, a pair of limbs mounted on and projecting from said handle ends, a pair of pulleys rotatably mounted on ends of said limbs remote from said handle, a draw string extending between said pulleys, and cables anchored at each said limb end and extending to said draw string around the pulley at the opposing limb end, characterized in that each said limb is attached to the associated end of said handle by limb attachment means that comprises:

a first internally threaded opening adjacent to said handle end, a second internally threaded opening adjacent to said handle end laterally intersecting said first opening, a thread insert in said first opening at a position intersecting said second opening, a limb-attachment screw extending through said limb into said first opening and threadably received in said thread insert, and a set screw threadably received in said second opening in external abutment with said thread insert to lock said limb-attachment screw in said thread insert.

34. The bow set forth in claim 33 further comprising a cable guide attached to said handle and extending to said cables, characterized in that said cable guide is attached to said handle by guide attachment means that comprises:

an opening in said handle that tapers narrowingly toward said cables, an internally threaded tapered bushing in said opening, and a screw extending from a side of said handle adjacent to said cables through said cable guide and threadably received in said bushing, such that said bushing is self-seating and self-tightening in said handle opening upon tightening of said screw to attach said cable guide.

35. The bow set forth in claim 34 wherein said opening and bushing are of conical geometry.

36. The bow set forth in claim 35 wherein said bushing as a passage extending entirely therethrough, said passage being internally threaded at both ends, the end of said bushing of greater diameter being adjacent to a surface of said handle remote from said cables to provide an internally threaded mounting opening for bow accessories.

37. The bow set forth in claim 33 wherein said limbs are each mounted on said handle ends by a screw that extends through the limb into said handle and bearing means adjacent to said screw to permit pivoting of the limb with respect to said handle end, characterized in that each said bearing means comprises:

a pair of aligned channels that extend in opposite lateral directions at said handle end, said channels having a circular cross-section viewed laterally of said handle, and a pair of part-spherical bosses on said limb and disposed in respective ones of said channels.

38. The bow set forth in claim 37 wherein said channels each have part-spherical ends adjacent to each other, such that said bosses on said limbs are self-centering in said channels upon tightening of said screw.

39. The bow set forth in claim 38 wherein said channels are of conical geometry, having a radius of curvature that increases laterally outwardly of each said channel.

* * * * *